United States Patent [19]

Miller

[11] 3,935,692

[45] Feb. 3, 1976

[54] REFUSE COLLECTOR AND BAGGING DEVICE

[76] Inventor: Jack E. Miller, 6216 Imperial Key, Tampa, Fla. 33615

[22] Filed: Jan. 13, 1975

[21] Appl. No.: 540,566

Related U.S. Application Data

[63] Continuation-in-part of Ser. No. 444,642, Feb. 21, 1974, abandoned.

[52] U.S. Cl. ..... 53/126; 53/124 B; 53/390; 141/74

[51] Int. Cl.[2] ..... B65B 1/22

[58] Field of Search ..... 53/126, 124 B, 390; 141/74, 75

[56] References Cited

UNITED STATES PATENTS

| | | | |
|---|---|---|---|
| 3,222,853 | 12/1965 | Michael | 53/124 B |
| 3,721,060 | 3/1973 | Quinto | 53/124 B |

*Primary Examiner*—Travis S. McGehee
*Attorney, Agent, or Firm*—Arthur W. Fisher, III

[57] ABSTRACT

A refuse collector and bagging device comprising a frame means configured to support at least one hopper means and a corresponding closure means in operative relation thereto, the hopper means retains a disposable refuse receptacle to receive refuse deposited therein. The closure means includes closure actuator means movable between a first and second position and closure element movable between an open and closed position attached thereto such that as the closure actuator means moves from the first to the second position the closure element moves from the normally open position to the closed position to isolate the upper portion of the hopper means from refuse to control the quantity of refuse deposited in the disposable refuse receptacle.

19 Claims, 9 Drawing Figures

REFUSE COLLECTOR AND BAGGING DEVICE

This application is a continuation-in-part application of co-pending application Ser. No. 444,642 filed Feb. 21, 1974, now abandoned.

BACKGROUND OF THE INVENTION

1. Field of the Invention

A refuse collector and bagging device including at least one hopper means configured to retain a corresponding refuse receptacle and a corresponding closure means to control the quantity of refuse deposited in the disposable refuse receptacle.

2. Description of the Prior Art

A number of methods have been developed to collect trash, leaves, grass and the like. Specifically, many lawn mowers include means to collect grass in a reusable receptacle as the grass is cut. The collected grass is then manually transferred to a receptable for disposal. Similar techniques include use of relatively large vacuums or blowers to displace the refuse such as leaves and grass into a collector for ultimate transfer to a receptacle for disposal. Unfortunately, such methods require relatively expensive machinery and awkward transfer of the refuse for disposal.

Trash cans and refuse containers are widely used for such ultimate disposal. Unfortunately, such means are not practical where large but periodical amounts of refuse such as leaves, grass and other lawn refuse are collected. As a result, a number of disposable bags have become available. However, these disposable bags are awkward to use and fill. Notwithstanding these limitations, these disposable trash bags are economical and useful. Given an economic and efficient means of filling these bags, their use would be greatly enhanced. Thus, a need exists for an effective, relatively inexpensive bagging means to assist in filling such disposable refuse or collection receptacles.

SUMMARY OF THE INVENTION

This invention relates to a refuse collector and bagging device for collecting grass, leaves, trash, grabage and the like. More specifically, the refuse collector and bagging device comprises a portable frame means configured to operatively support at least one hopper means and a corresponding closure means.

The frame means includes a lower frame element mounted on a plurality of rollers interconnected to opposite sides of the frame means to facilitate movement of the refuse collector and bagging device over the supporting suface. A plurality of vertical frame members extend upwardly from the lower frame element to support the hopper means. The frame means also includes a shaker means interconnected between the roller means and closure means to settle refuse in a disposable refuse receptacle attached to the hopper means as more fully described hereinafter.

The hopper means comprises a hopper including an upper cone-like funnel or entrance affixed to the vertical frame elements and a lower hollow substantially cylindrical body rotatably mounted thereon. The lower hollow body extends downward to a lower reduced exit which retains the disposable refuse receptacle.

The closure means comprises a closure frame means, closure actuator means and closure element. Each closure means is arranged relative to the corresponding hopper means to control the quantity or amount of refuse placed within the disposable refuse receptable as more fully described hereinafter.

The closure frame means comprises a pair of substantially vertical forward stationary closure members and a pair of rear stationary closure members interconnected to the frame means to operatively support the closure actuator means and closure element. The closure actuator means comprises a first and second positioning means disposed on opposite sides of the corresponding hopper means.

The first positioning means includes a pair of first actuator elements slidably mounted on opposite forward stationary closure frame members. Each first actuator element comprises a vertical sleeve and a substantially vertical first rack member having a plurality of teeth formed thereon attached thereto. The first actuator elements are normally biased in the upper or first position by a bias means interconnecting the vertical sleeves and the forward stationary closure frame members. A platform is attached to the lower portion of each set of vertical sleeves. The second actuator element comprises a substantially horizontal second rack member having a plurality of teeth formed thereon and a pinion means. A pinion means comprising a pair of pinion gears rotatably mounted on the hopper. The pinion gears are disposed to operatively engage the first and second rack members to move the closure actuator means from the first to second or lower position as refuse is placed in the receptacle to move the closure members from the open to closed position as described more fully hereinafter.

The second positioning means is similar in construction to the first positioning means but mounted on the rear stationary closure frame members.

The closure element comprises a first and second closure member coupled to the first and second positioning means respectively. Each closure member includes a plurality of elements which cooperatively close the hopper means as more fully described hereinafter.

In an alternate embodiment the closure frame comprises a flexible forward and rear closure member. The upper portions of the flexible forward and rear closure members are attached to the hopper means while the lower portions thereof including resilient bias means are attached to the platform beneath the hopper means. The closure actuator means comprises a flexible interconnecting element fixed at one end of the frame means and coupled to the rear closure member at the opposite end. The mid-portion of the flexible interconnecting element operatively engages the closure element while the end coupled to the rear closure member operatively engages a pulley means to move the closure actuator means from the first to second or lower position as refuse is placed in the receptacle to move the closure members from the open to closed position as described more fully hereinafter.

In the alternate embodiment the closure element comprises a first closure member coupled to the flexible interconnecting element and a second closure member fixed to the hopper means.

The refuse collector and bagging device further includes a receptacle twist means attached to the hopper means to rotate the hopper means as the closure element moves to the closed position.

In operation, a disposable refuse receptacle is secured to the hopper means by a resilient attachment means. Without any refuse in the receptacle, the bias means will bias the closure means in the first position withdrawing the first and second clsoure members to the open position. As refuse is deposited into the receptacle, the additional weight acting against the platform draws each sleeve downward relative to the stationary closure frame members. Since the first pinion gear engages the first actuator elements, this downward movement rotates the second pinion gears which in turn engage the second actuator elements moving the closure members inwardly relative to each other to the second or closed position to isolate additional refuse from the hopper means. Simultaneously, the hopper body is rotated by the receptacle twist means. As the refuse collector is moved over the supporting surface, the shaker means moves the platform fore and aft settling the contents thereof.

In the operation of the alternate embodiment, as refuse is deposited into the disposable refuse receptacle, the additional weight acting against the platform draws the lower portions of the flexible forward and rear frame members downward against the resilient bias. Simultaneously, the flexible interconnecting element is drawn downward over the pulley forcing the first closure member rearward to close the hopper means. The receptacle twist means and shaker means of the alternate embodiment operate similarly to that previously described with the preferred embodiment.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 2:
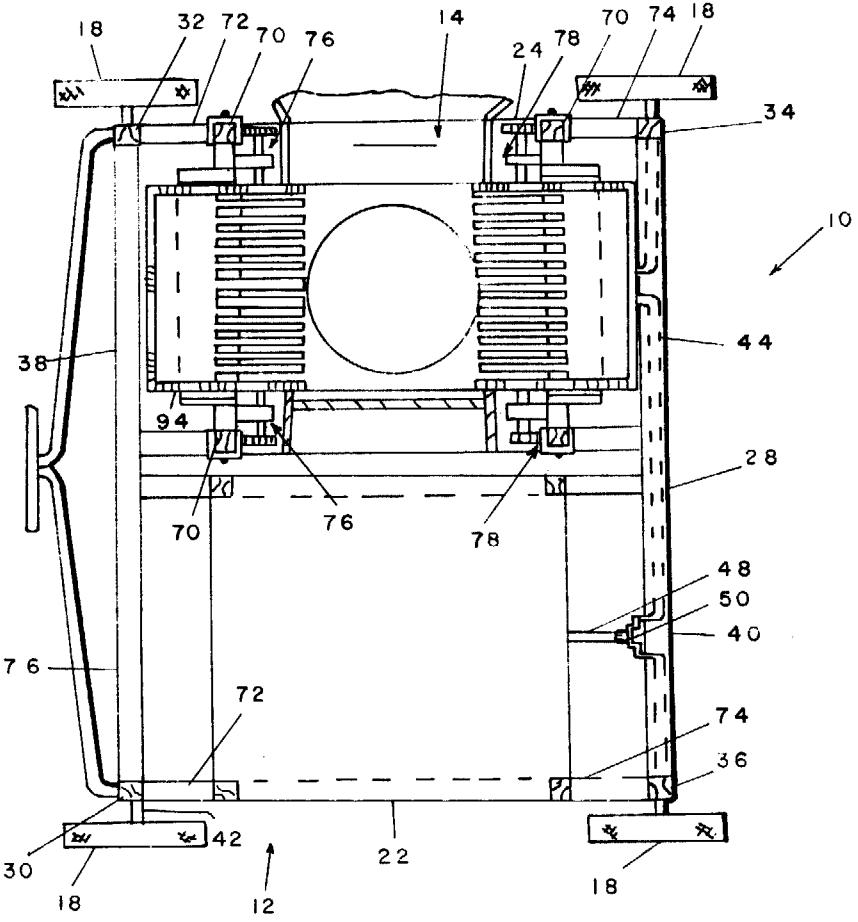
FIG. 2 is a top view of the refuse collector and bagging device.
Figure 1:
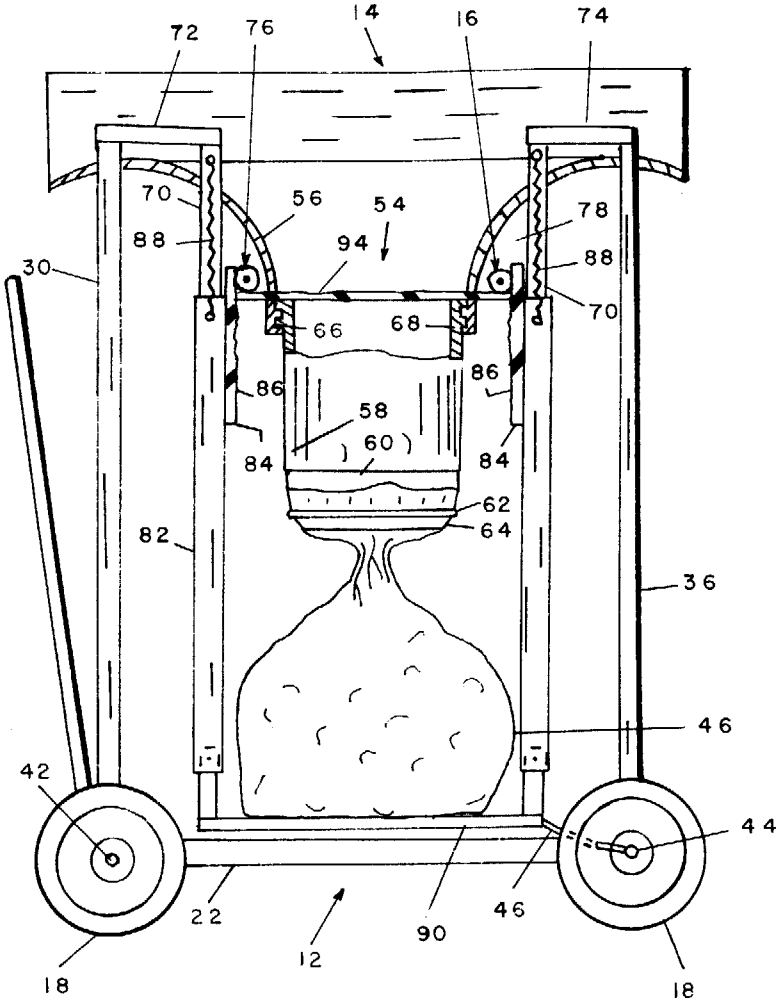
FIG. 1 is a side view of the refuse collector and bagging device.

As shown in FIGS. 1 and 2 the present invention comprises a refuse collector and bagging device generally indicated as 10 for collecting grass, leaves, trash or the like. Refuse collector 10 comprises a frame means 12 configured to operatively support at least one hopper means generally indicated as 14 and a corresponding closure means 16. Frame means 12 is mounted on a plurality of rollers or wheels 18 for movement over a supporting surface by means of handle 20.

Frame means 12 comprises lower frame element including side frame members 22 and 24 held in fixed parallel spaced relation relative to each other by lower front and rear frame members 26 and 28 respectively as best shown in FIG. 2. Extending upwardly from each of the four corners of lower frame element are vertical frame members 30, 32, 34 and 36 disposed in substantially parallel relation relative to each other. Forward vertical frame members 30 and 32 are interconnected by upper front frame member 38 while rear vertical frame members 34 and 36 are interconnnected by upper rear frame member 40. As best shown in FIG. 2, rollers 18 are interconnected to opposite sides of frame means 12 by front and rear axles 42 and 44 respectively extending through front and rear lower frame members 26 and 28 respectively. Frame means 12 further includes shaker means to settle refuse in disposable refuse receptacles 46 as more fully described hereinafter. Shaker means includes shaker element 48 movably coupled to rear axle 44 at U-shaped portions 50 and to closure means 16 more fully described hereinafter.

Hopper means 14 includes hopper 54 comprising upper cone-like funnel or entrance 56 affixed to frame means 12 and hollow substantially cylindrical body 58 extending downward to lower reduced exit 60. Substantially annular retainer means or lip 62 extends about the periphery of exit 60 to cooperate with resilient attachment means 64 to secure receptable 46 thereto. Mounting means comprising annular groove 66 is formed about the upper portion or periphery of body 58 which receives annular rim 68 formed on funnel 56 to rotatably mounted body 58 on funnel 56.

Figure 3:
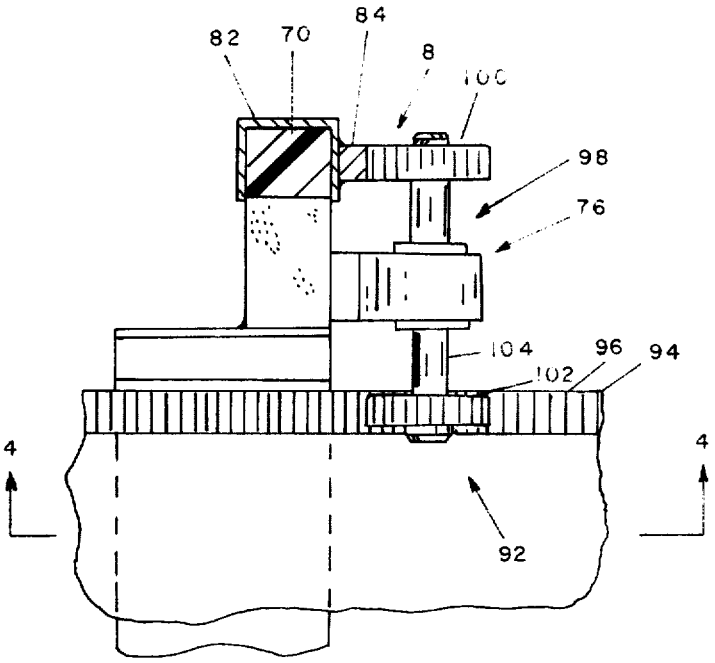
FIG. 3 is a partial detail top view of the closure means.
Figure 4:
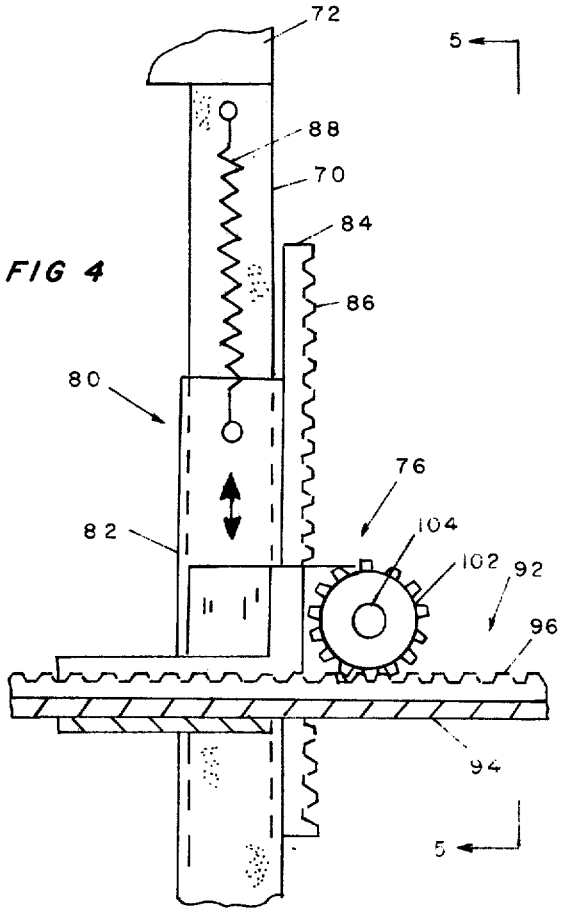
FIG. 4 is a partial detail side view of the closure means taken along line 4—4 of FIG. 3.
Figure 5:
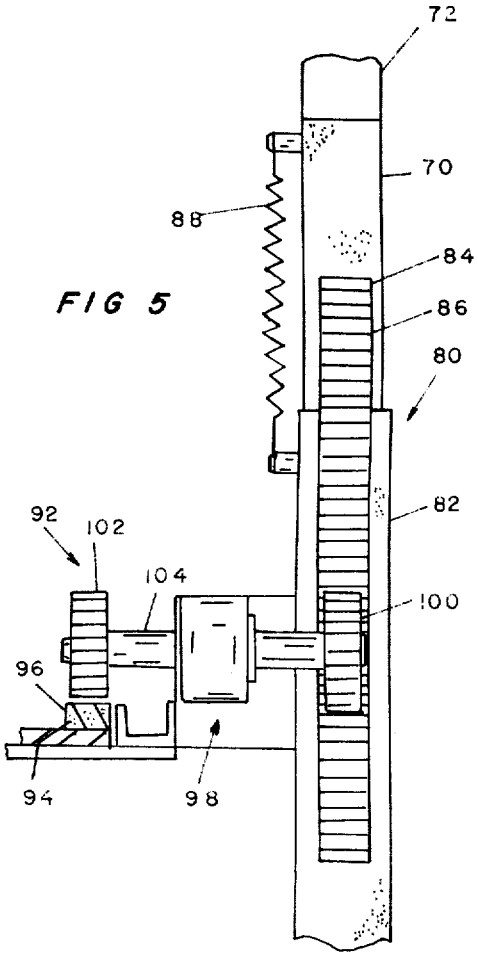
FIG. 5 is a partial detail rear view of the closure means taken along line 5—5 of FIG. 4.

Closure means 16 is disposed relative to hopper means 14 to control the volume or amount of refuse placed therein. As best shown in FIG. 3 through 5, closure means 16 comprises closure frame means, closure actuator means and closure element. Closure frame means comprises stationary closure frame members 70 extending vertically to cooperatively form a rectangular frame. Forward stationary closure frame members 70 are interconnected to upper front frame member 38 by substantially horizontal forward interconnecting members 72 while rear stationary closure frame members 70 are interconnected to upper rear frame member 40 by substantially horizontal rear interconnecting members 74. Closure actuator means comprises substantially indentical first and second positioning means 76 and 78 respectively disposed on opposite sides of hopper means 14. First positioning means 76 include first actuator elements 80 sildably mounted on opposite forward stationary closure frame members 70. Each first actuator element 80 comprises vertical sleeve 82 and substantially vertical first rack member 84 having a plurality of teeth 86 formed thereon attached thereto. First actuator elements 80 are normally biased in the upper or first position by bias means 88 operatively coupled between interconnecting sleeve 82 and stationary closure frame members 70. The lower portion of sleeve 82 is pivotally interconnected between the upper portion thereof and platform 90. Second actuator element 92 comprises substantially horizontal second rack member 94 having a plurality of teeth 96 formed thereon. Pinion means 98 comprises first and second pinion gears 100 and 102 respectively rotatably mounted on hopper means 14 by interconnecting means or ord 104. As shown in FIG. 1, pinion gears 100 and 102 respectively are disposed to operatively engage first and second rack members 84 and 94 respectively to move closure actuator means from the first to second position as refuse is placed in receptable 46 moving closure members 106 and 108 from the open to closed position as described more fully hereinafter. Second positioning means 78 is similarly configured and are similarly numbered.

Figure 6:
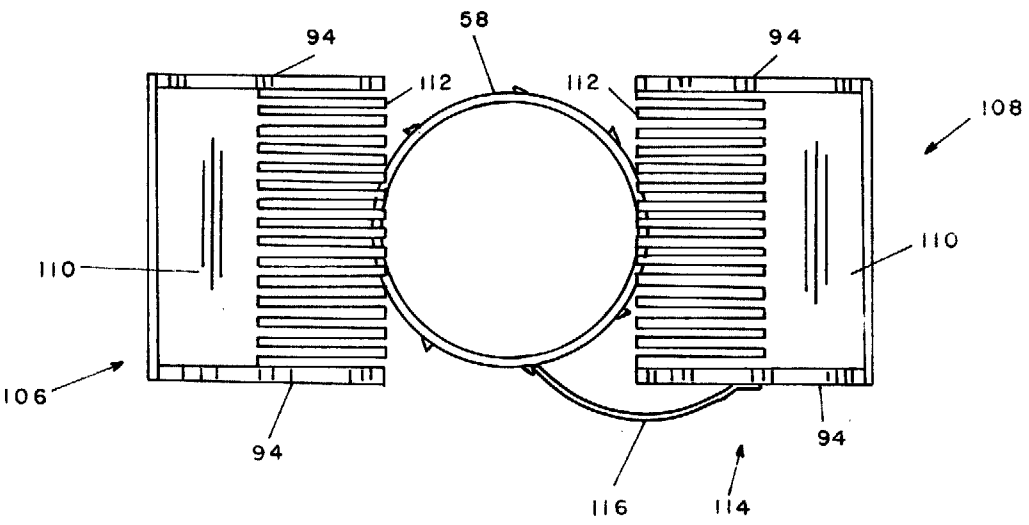
FIG. 6 is a partial detail top view of the hopper means.

As shown in FIG. 6, the closure element comprises first and second closure member 106 and 108 coupled to first and second positioning means 76 and 78 respectively. Each closure member includes interconnecting element 110 interconnected between opposite forward second rack member 94 and opposite rear second rack members 94. Each closure member includes a plurality of element 112 which cooperatively close hopper means 14 as more fully described hereinafter.

Refuse collector 10 further includes receptacle twist means generally indicated as 114 in FIG. 6. Receptacle twist means 114 comprises twist linkage 116 interconnecting second rack 94 and body 58 to rotate body 58 as the closure element moves to the closed position.

Figure 8:
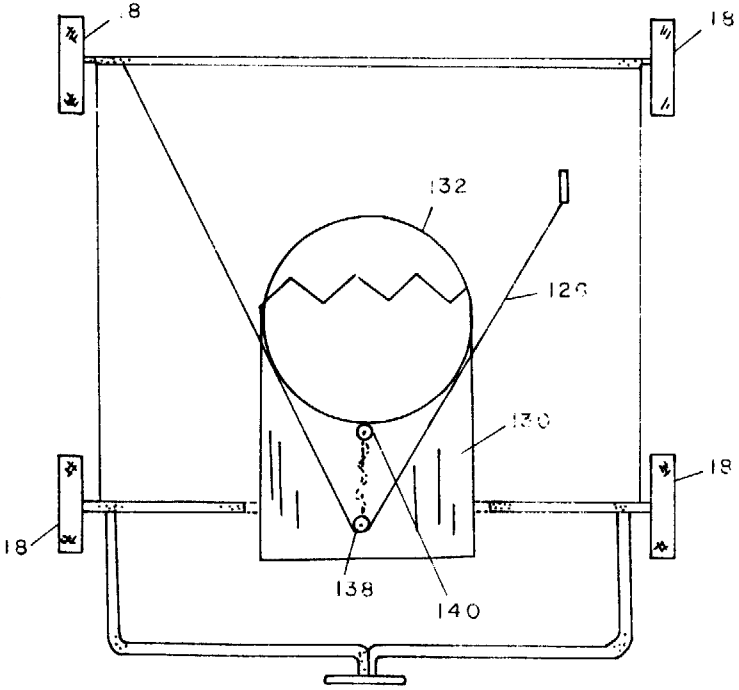
FIG. 8 is a top view of an alternate embodiment of the refuse collector and bagging device.
Figure 7:
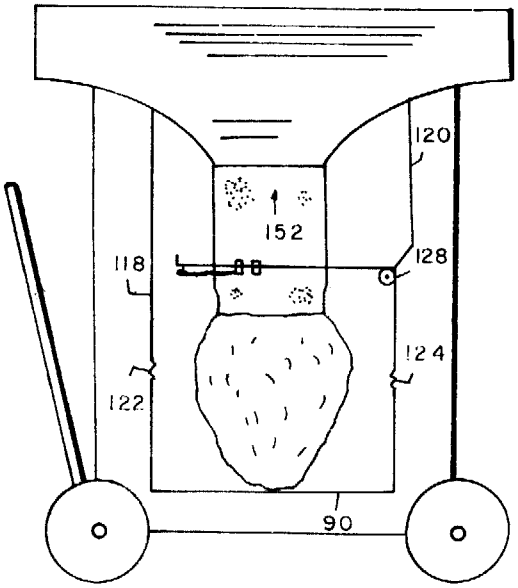
FIG. 7 is a side view of an alternate embodiment of the refuse collector and bagging device.
Figure 9:
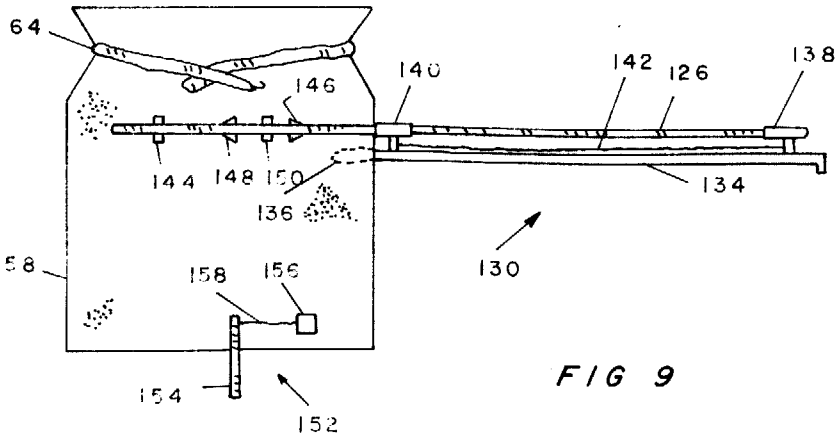
FIG. 9 is a partial detail view of the closure means of the alternate embodiment of the refuse collector and bagging device.

FIGS. 7 through 9 show an alternate embodiment of the refuse collector and bagging device. In the alternate embodiment as shown in FIG. 7 the closure frame comprises a flexible forward and rear closure member 118 and 120 respectively. The upper portions of the flexible forward and rear closure members are attached to the hopper means 14 while the lower portions thereof including resilient bias means 122 and 124 respectively are attached to the platform 90 beneath the hopper means 14. The closure actuator means comprises a flexible interconnecting element 126 fixed at one end of the frame means and coupled to the rear closure member 120 at the opposite end. As best shown in FIGS. 8 and 9 the mid-portion of the flexible interconnecting element 126 operatively engages the closure element while the end coupled to the rear closure member operatively engages a pulley means 128 to move the closure actuator means from the first to second or lower position as refuse is placed in the receptacle to move the closure members from the open to closed position as described more fully hereinafter.

In the alternate embodiment the closure element comprises a first closure member 130 coupled to the flexible interconnecting element 126 and a second closure member 132 fixed to the hopper means 14. The first closure element 130 comprises horizontal platform member 134 disposed to pass through a slot 136 formed on hopper means 14, control roller 138, guide roller 140 and closure element return means 142 extending therebetween to normally bias the first closure element 130 to the open position.

The alternate embodiment of the refuse collector and bagging device also includes a receptacle twist means attached to the hopper means 14 to rotate the hopper body 58 as the first closure element 130 moves to the closed position. As shown in FIG. 9, the receptacle twist means comprises spaces guide 144, first and second limit means 146 and 148 respectively and twist actuator element 150. Spacer guide 144 and twist actuator element 150 which include apertures to receive element 126 are fixed to hopper body 58 while first and second limit means 146 and 148 are affixed to element 126. The receptacle twist means further include a return means generally indicated as 152. The return means 152 comprises first return member 154 attached to the fixed portion of the hopper, second return member 156 attached to the rotatable hopper body 58 and return bias means disposed to operatively engage the first and second return member 154 and 156 to normally bias the hopper body 58 to the normal or untwisted position.

In operation, disposable refuse receptacles 46 are secured to hopper means 14 by resilient attachment means 64. Without any refuse in receptacle 46, bias means 80 will bias closure means in the first position withdrawing first and second closure members 106 and 108 respectively. As refuse is deposited into receptacle 46, the additional weight acting against platform 90 draws each sleeve 82 downward relative to stationary closure frame members 70. Since pinion gears 100 engage first rack element 84, this downward movement rotates pinion gears 100 which in turn rotates pinion gear 102 engaging second rack elements moving closure members 106 and 108 inwardly relative to each other to the second or closed position to isolate additional refuse from hopper means 14. Simultaneously, hopper body 58 is rotated by interconnecting twist linkage 116. As refuse collector and bagging device 10 is moved over the supporting surface shaker element 48 moves fore and aft swinging platform 90 fore and aft settling the contents thereof. As shown in FIG. 2 two or more identical devices may be mounted on the same frame. In the operation of the alternate embodiment, as refuse is deposited into the disposable refuse recpetacle 46, the additional weight acting against the platform 90 draws the lower portions of the flexible forward and rear frame members 118 and 120 downward against the resilient bias 122 and 124. Simultaneously, the flexible interconnecting element 124 is drawn downward over the pulley means 128 acting against control roller 138 forcing the first closure member 130 rearward to close the hopper means. The receptacle twist means and shaker means of the alternate embodiment operate similarly to that previously described with the basic embodiment. Specifically as the flexible interconnecting element 124 is drawn downward, first limit means 146 engages twist actuator element 150 rotating hopper body 58 thereby twisting the disposable refuse receptacle 46. Upon removal of the receptacle 46 from the platform 90, the return means 152 will return the hopper body 58 to its normal position. This action causes second limit means 148 to engage twist actuator element 150 releasing tension on the flexible interconnecting element 124 permitting closure element return means to return the first closure element 130 the open position.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A refuse collector for collecting refuse, said refuse collector comprising frame means, at least one hopper means attached to said frame means, said hopper means including an upper portion having an entrance formed therein to receive the refuse and a lower portion having an exit formed therein to direct the refuse from said hopper means, retainer means formed on said lower portion to retain a refuse receptacle thereon to receive refuse directed through said hopper means, closure means disposed in operative relationship relative to said hopper means, said closure means including closure actuator means movable between a first and second position and closure element operatively interconnected to said closure actuator means to move between an open and closed position, said closure actuator means including bias means to bias said closure actuator means in said first position, said closure actuator means further including platform means to engage the refuse receptacle to move said closure actuator means from said first to said second position as a predetermined amount of refuse is placed in the refuse receptacle, said closure element coupled to said closure actuator means to move from said open to said closed position when said closure actuator means is in said second position, said closure element disposed relative to said hopper means to isolate said hopper means from the refuse to control the amount of refuse deposited in the refuse receptacle.

2. The refuse collector of claim 1 wherein said closure means further includes closure frame means attached to said frame means, said closure frame means including a pair of forward stationary closure frame members attached to said hopper means said closure actuator means including a first positioning means having a first pair of actuator elements slidably mounted on said forward closure frame members, said first positioning means further including a second pair of actuator elements operatively interconnected to said first pair of actuator elements to move said second actuator elements to the closed position.

3. The refuse collector of claim 2 wherein said closure frame means further includes a pair of rear stationary closure frame members, said closure actuator means further including a second psoitioning means, said first and second positioning means disposed on opposite sides of said hopper means, said second positioning means including first pair actuator elements slidably mounted on said rear closure frame members, said second positioning means further including a second pair of actuator elements operatively interconnected to said first pair of actuator elements to move siad second actuator elements to the closed position.

4. The refuse collector of claim 2 wherein each said first actuator element comprises a substantially vertical sleeve movably mounted on corresponding stationary closure frame members, and a substantially vertical first rack member having a plurality of teeth formed thereon and wherein each said second actuator element comprises a substantially horizontal second rack member having a plurality of teeth formed thereon and a pinion means, said pinion means comprising a first and second gear element operatively coupled to each other, said first and second gear elements rotatably mounted on said hopper means, said first and second gear elements disposed to engage said first and second rack members respectively.

5. The refuse collector of claim 4 wherein said closure element comprises a first and second closure member coupled to said first and second positioning means respectively.

6. The refuse collector of claim 5 wherein each said closure member includes an interconnecting element interconnected between opposite forward second rack members and rear second rack members respectively.

7. The refuse collector of claim 6 wherein each said closure member comprises a plurality of elements mounted on said interconnecting elements. rod receptacle 8. The refuse collector of claim 2 wherein said hopper means includes mounting means formed thereon, said mounting means comprising a groove formed in said upper portion and a rim formed on said lower portion.

9. The refuse collector of claim 8 wherein said closure means further includes receptacle twist means, said receptacle twist means comprising a twist linkage interconnecting at least one of said second rack members and said lower portion to rotate said lower portion to rotate said lower portion relative to said upper portion as said closure elements move to said closed position.

10. The refuse collector of claim 1 wherein said closure means further includes closure frame means attached to said frame means, said closure frame means comprises a forward and rear closure member attached to s id hopper means, said forward and rear closure members each comprising an upper and lower portion interconnected by bias means said lower portions of said closure members being movably between a first and second position, said closure actuator means comprising a pulley means rotatably attached to said hopper means and flexible interconnecting element operatively coupled between said frame means and said rear closure member, said flexible interconnecting means disposed to operatively engage said closure element and said pulley means to move said closure element to the closed position when said lower portions are in said second position.

11. The reference collector of claim 10 wherein said closure element comprises a substantially horizontal platform member disposed to pass through a slot formed in said hopper means, said substantilly horizontal platform member including a control roller to engage said flexible interconnecting element.

12. The refuse collector of claim 11 wherein said upper portion of said hopper means is fixedly attached to said frame means and said lower portion of said hopper means is rotatably mounted on said upper portion of said hopper means, said lower portion of said hopper means rotatably between a first and second position.

13. The refuse collector of claim 12 wherein said closure means further includes receptacle twist means, said receptacle twist means comprisng a first limit means fixedly attached to said flexible interconnecting element and first actuator means, affixed to said lower portion of said hopper means, said first limit means being disposed to engage said twist actuator means when said lower portions of said closure members are in said second position said lower portion of said hopper means is rotated to said second position.

14. The refuse collector of claim 13 wherein said receptacle twist means further includes a second limit means fixedly attached to said flexible interconnecting element and a return means movable between a first and second position, said return means coupled between said upper and lower portions of said hopper means, said first and second limit means arranged in spaced relation relative to each other, said twist actuator means disposed between said first and second limit means, said return means being in said first position when said lower portion of said hopper is in said first position and in said second position when said lower portion of said hopper is in said second position, said return means movable from said first position to said second position when said lower portion of said closure members are in said second position and movable from said second position to fixed first position when said lower portion of said closure members are in said first position, said second limit means disposed to engage said twist actuator means to return said lower portion of said hopper means to said first position when said return means is moved from said second to said first position.

15. The refuse collector of claim 14 wherein said return means comprises a first return member attached to said upper portion of said hopper means, a second return member attached to said lower portion of said hopper means and return bias means disposed between said first and second return members.

16. The refuse collector of claim 4 wherein the lower portion of said first actuator means of said forward and rear actuator means are pivotally coupled to the upper portion of said forward and rear said actuator means respectively, said lower portion being pivotally interconnected by said platform means.

17. The refuse collector of claim 16 wherein said frame means further includes shaker means interconnected between said frame and said closure means to move said platform relative to said frame means as said refuse collector is moved over the supporting surface.

18. The refuse collector of claim 17 wherein said frame means comprises the lower frame element mounted on roller means.

19. The refuse collector of claim 1 wherein said lower portion includes retainer means formed thereon, said retainer means comprising an annular lip to engage the refuse receptacle to operatively support and retain said refuse receptacle.

* * * * *